US006549142B2

(12) United States Patent
Thomas et al.

(10) Patent No.: US 6,549,142 B2
(45) Date of Patent: Apr. 15, 2003

(54) AUDIO ALERTS IN PHYSICAL ENVIRONMENTS

(75) Inventors: Andrew Thomas, Atherton, CA (US); Stephen John Hinde, Bristol (GB); Martin Sadler, Bristol (GB)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/994,935

(22) Filed: Nov. 28, 2001

(65) Prior Publication Data

US 2002/0067257 A1 Jun. 6, 2002

(30) Foreign Application Priority Data

Dec. 1, 2000 (GB) ..... 0029292

(51) Int. Cl.[7] ..... G08B 21/00
(52) U.S. Cl. ..... 340/691.1; 340/565; 340/384.1
(58) Field of Search ..... 340/691.1, 540, 340/541, 552, 565, 517, 457, 573.1, 692, 384.1, 384.5, 384.7, 384.73; 704/270, 273

(56) References Cited

U.S. PATENT DOCUMENTS 4,023,151 A 5/1977 Markham ..... 340/692
4,544,920 A * 10/1985 Hamlin ..... 340/565
4,912,457 A 3/1990 Ladd ..... 340/286.01
5,365,214 A * 11/1994 Angott et al. ..... 340/328
5,493,692 A * 2/1996 Theimer et al. ..... 455/26.1
5,532,680 A * 7/1996 Ousbourne ..... 340/567
5,786,760 A * 7/1998 Suzuki et al. ..... 340/541
6,307,475 B1 * 10/2001 Kelley ..... 340/573.1

FOREIGN PATENT DOCUMENTS

GB 2 215 104 9/1989
GR 2 270 585 3/1994

OTHER PUBLICATIONS

Mynatt, Elizabeth D., et al., "Designing Audio Aura," Xerox Palo Alto Research Center, Palo Alto, CA 94304.

Abstract of Japanese Patent Application No. JP9081176 "Message Information Arrangement Device".

Abstract of Japanese Patent Application No. JP8077462 "Operation State Notifying Device Using Sound".

* cited by examiner

*Primary Examiner*—Toan Pham

(57) ABSTRACT

Audio alerts are provided in an environment, such as a house, concerning categorized events to be reported. Examples of the events are receipt of e-mails and voice mails. The presence of a person entering or leaving a space of the environment is detected and a processing system determines reportable event categories that have occurred. Each possible event category has a corresponding audio signature. The event categories signatures that have occurred are played either simultaneously or sequentially, within the hearing of the person detected.

18 Claims, 2 Drawing Sheets

| ALERT TRIGGER | EVENT CATEGORY | | ALERT STYLE |
|---|---|---|---|
| | TYPE AXIS | RECIPIENT AXIS | |
| SENSOR 12A | ALL | ALL | MUSICAL |
| SENSOR 12B | ALL | OCCUPIER ROOM B | VERBAL |
| SENSOR 12C | ALL | OCCUPIER ROOM C | VERBAL |
| SENSOR 12D | HOUSE STATUS | ALL | VERBAL |
| SENSOR 12E | E-MAIL V-MAIL | ALL | VERBAL |

Figure 2

AUDIO ALERTS IN PHYSICAL ENVIRONMENTS

FIELD OF THE INVENTION

The present invention relates to providing, in a physical environment, audio alerts in respect of categorised events to be reported.

BACKGROUND OF THE INVENTION

It is known to provide an audible alert at a user's PC of the receipt of new e-mail in the user's e-mailbox inbox. It is also known from JP 9081176 to automatically announce messages when a person enters a porch or a room. The advantage of such techniques is that the user is informed without having to look in any particular direction and without having specifically asked if a message has been received.

It is an object of the present invention to extend and improve the usefulness of audio alerts.

SUMMARY OF THE INVENTION

According to one aspect of the present invention, there is provided a method of providing, in a physical environment, audio alerts in respect of categorised events to be reported; the method involving the steps of:

(a) detecting a person crossing a boundary of a space of the environment;

(b) no later than immediately following the detection of the person in step (a), determining what categories of events that are to be reported, have occurred;

(c) selecting from a set of predetermined audio signatures that each corresponds to a different possible category of event, the signature or signatures appropriate for the event categories determined in step (b); and (d) outputting, within the hearing of the person detected in step (a), the signatures selected in step (c).

According to another aspect of the present invention, there is provided a system for providing, in a physical environment, audio alerts in respect of categorised events to be reported; the apparatus comprising:

a sensor arrangement for detecting a person crossing a boundary of a space of the environment;

a processing subsystem comprising:

first means operative, no later than immediately following the detection of a person crossing a boundary by the sensor arrangement, to determine what categories of events that are to be reported, have occurred; and second means for selecting from a set of predetermined audio signatures that each corresponds to a different possible category of event, the signature or signatures appropriate for the event categories determined by the first means;

an audio output arrangement for outputting, within the hearing of the person detected by the sensor arrangement, the signatures selected by the second means of the processing subsystem either simultaneously or sequentially.

BRIEF DESCRIPTION OF THE DRAWINGS

A method and system embodying the invention, for providing audio alerts, will now be described, by way of non-limiting example, with reference to the accompanying diagrammatic drawings, in which:

FIG. 2 is a table showing the relation between the identity of an activated sensor and the event categories reported for the environment of FIG. 1.

BEST MODE OF CARRYING OUT THE INVENTION

Figure 1:
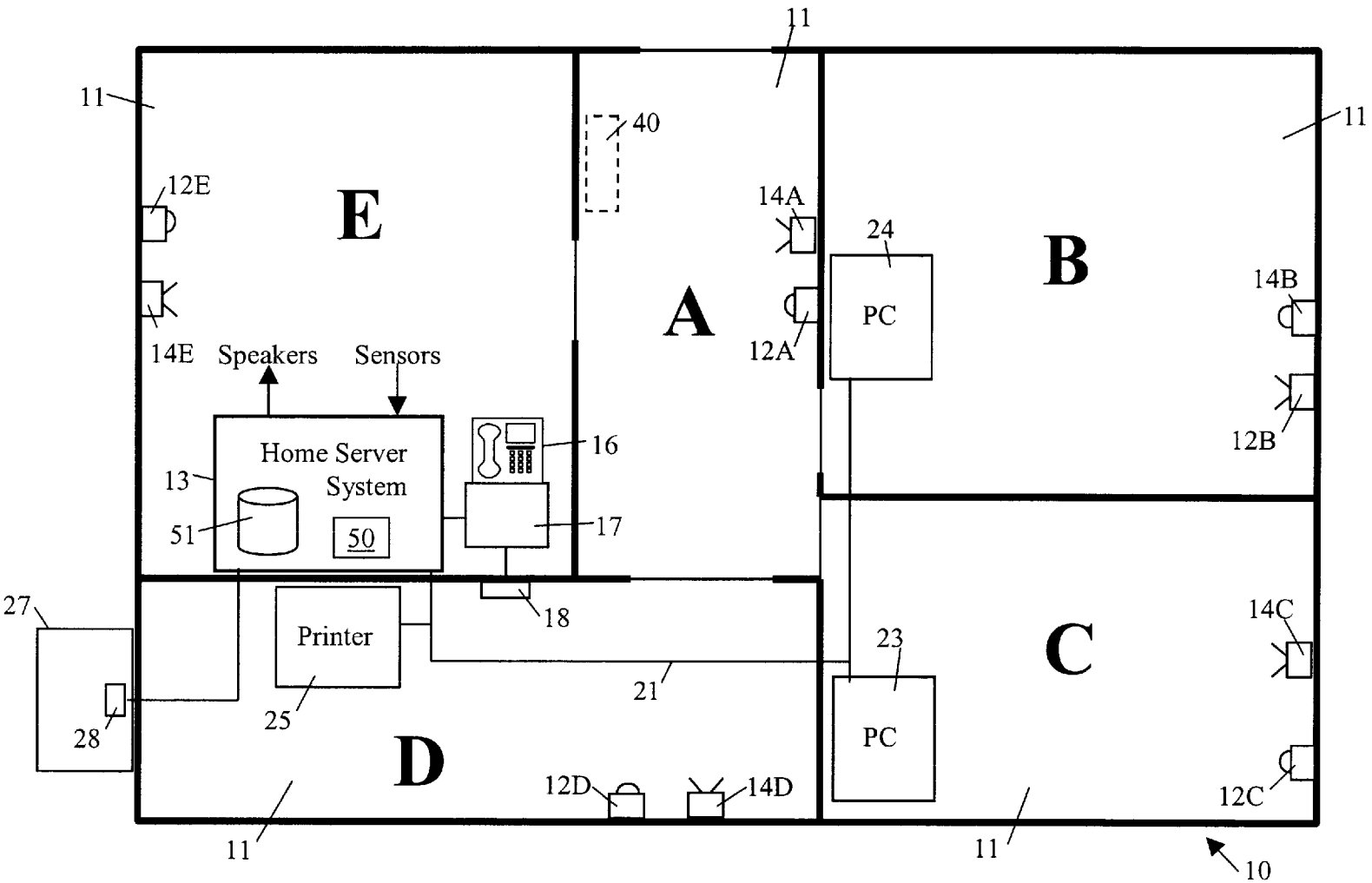
FIG. 1 is a diagram, in plan view, of a house environment provided with the audio alert system.

FIG. 1 depicts a house 10 having five spaces 11 hereinafter referred to as rooms A to E. Room A is an entrance hall, rooms B and C are individually-occupied rooms, room D is a kitchen/utility room area, and room E is a lounge/study room. In each room A–E is a respective presence sensor 12A–12E for detecting when a person is present in the room and, in particular, when a person enters an empty room. The sensors 12 are, for example, infrared movement detectors as commonly used in intruder alarm systems.

The sensors 12A–12E are individually connected back to a home server system 13 by wire links or by radio links. The system is responsible for receiving activation signals from the sensors and taking appropriate action according to an alert program 50 run by the server system. In particular, the server system is operative to output appropriate audio alerts in respect of categories of events to be reported, these alerts being output via loudspeakers 14A–14E disposed in each room A–E respectively. The alerts can be output from the server system to all speakers or only to the speaker in the room where the sensor was activated. The speakers are connected to the server system by wireline or wireless connections.

The events to be reported are of a number of different types, namely:

receipt of e-mails in e-mail inboxes hosted on the server. These may be e-mails sent between occupants of the house over the house LAN 21 from individual PCs 23 and 24 in rooms B and C, or emails downloaded from a remote server by server 13 (this can be done periodically by the server under program control). LAN 21 although depicted as a cabled LAN could, of course, be a radio LAN. Receipt of an e-mail results in the alert program being notified.

receipt of voice mails in a home voice-mail system 17 either via the external connection to telephone 16 or from internal voice messaging terminals such as terminal 18 in room D. The voice-mail system is connected to the server system to enable the alert program to be informed of each voice mail as received.

individual reminder lists generated on PCs 23, 24 but stored on the server system 13 and readable by the alert program which it does at periodic intervals, scanning for reminders concerning overdue items or items due in the near future.

house status events such as low oil level in heating oil tank 27 (this is detected by sensor 28 connected back to the home server system 13) or out-of-paper status of printer 22 (this status is reported over LAN 21 to server system 13). These events are notified to the alert program.

The alert program 50 stores in store 51 a record of each reported event and its type. Also, for each event, an indication is made of the associated intended recipient (this is the addressee of e-mails and voice mails, and the author of reminder items; house status events can be considered as intended for all occupants).

The possible events are categorised according to the combination of event type and intended recipient. Thus, for example, there is a respective category for each combination of the e-mail event type with each possible recipient. For each reported event, the event category is stored with the event record; indeed, for present purposes, it is only necessary to record what categories of event have occurred rather than a record of each event.

For each event category, two audio signatures are stored in store 51, one signature being a verbal announcement of the event category and the other signature being musical in form, such as an extract from a piece of music, a chord or a tone. These signatures are intended to be played through loudspeakers 14 to alert the house occupants of the events to be reported.

In the present embodiment, both the categories of events to be reported and the style of the alert (verbal or musical signature) depends on which sensor is activated, this dependency being specified in table 52 held in store 51. Table 52 is depicted in FIG. 2. As can be seen, if a person enters room A (for example, on entering the house) causing sensor 12A to be activated, then all event categories are to be reported in musical style. In contrast, if a person enters room B activating sensor 12B, then only event categories (of all type) relating to the room B normal occupant are to be reported, this time verbally; note that house status events are reported as they are intended for general receipt. Again, if a person enters the study room E where both e-mails and voice mails can be accessed, then activation of sensor 12E causes only e-mail and v-mail event types to be reported but for all recipients.

The operation of the audio alert system is as follows. Events of all categories are reported (or derived by diary scanning for the reminder events) on an on-going basis and the alert program creates a list of the categories of such events. In due course a sensor 12 is activated, for example, sensor 12 A is activated by a person entering the house. This causes the alert program to read from table 52 which categories of events are to be reported and with what style of alert. The alert program then retrieves the corresponding audio signatures from the store 51 and plays the audio signatures at least to the speaker in the room where the sensor has been activated. For a person entering room A, the musical signatures of all event categories that have occurred are played, either in sequence or all together. When the person enters another room, the alert program again plays the appropriate audio signatures (which will be verbal announcements and therefore preferably played in sequence).

In this way, persons entering rooms in the house 11 are conveniently informed of event categories of events that have occurred.

Of course, where the sensors are movement sensors for a volume, rather than sensors just detecting passage across a boundary, appropriate logic is preferably applied to interpret the activation signals from the sensors in order to determine when a person moves from one room to another, alerts only being output when a person enters a room. Regardless of the type of sensor, it may well not be necessary to monitor every room or every doorway as logic associated with the sensors can be arranged to imply entry into a room as a result of detecting exit from an adjoining room through a doorway joining the rooms.

Preferably, the sensors and their associated logic is such as to enable a determination of when a room is empty, with alerts only being given when an empty room is entered.

Many variants are, of course, possible to the arrangement described above with reference to FIGS. 1 and 2. For example, the sensors 12 could be the sensors of an intruder alarm system suitably coupled to the server system. Alternatively, rather than using sensors in every room, in an minimal system only entry into the house is detected (and where the house is provided with an intruder alarm system, normal entry into the house can, for example, be determined by detecting de-activation of the alarm system).

It is also possible to arrange for the alerts to be given when a person leaves a particular room (or leaves the house), if that person is leaving the space concerned without having to attended to outstanding events relevant to the space being left. Thus, in general terms, the alerts are triggered by sensing a person crossing a boundary of a particular space.

Whilst the list of categories of events that have occurred was built up progressively in the described embodiment, it is of course possible to effect the determination of the categories of events that have occurred at the time a sensor is activated; to do this, the alert program is provided with the ability to interrogate the sources of events.

The environment 10 is not limited to being a house but would typically be restricted to an area which only a small number of people usually frequented.

What is claimed is:

1. A method of providing, in a physical environment, audio alerts in respect of categorized events to be reported; the method comprising the steps of:

(a) detecting, without identifying, a person crossing a boundary of a space of the environment;

(b) no later than immediately following the detection of the person in step (a), determining what categories of events that are to be reported, have occurred, each event being categorized at least according to the person or persons to be alerted in respect thereof;

(c) selecting from a set of predetermined audio signatures that each corresponds to a different possible category of event, the signature or signatures appropriate for the event categories determined in step (b); and (d) outputting, within the hearing of the person detected in step (a), the signatures selected in step (c).

2. A method according to claim 1, wherein step (a) is effected using a plurality of sensors and the event categories to be reported are selected according to which sensor is activated by said person.

3. A method according to claim 1, wherein step (a) is effected using the sensors of an intruder alarm system.

4. A method according to claim 1, wherein step (a) is effected by detecting the deactivation of an intruder alarm system.

5. A method according to claim 1, wherein events are further categorized by type, these event types comprising at least two of:

the receipt of e-mail;

the receipt of voicemail;

status events regarding equipment in the environment;

reminders recorded in an electronic diary.

6. A method according to claim 1, wherein said audio signatures are verbal announcements.

7. A method according to claim 1, wherein said audio signatures are musical in form with each signature being one of a music extract, a musical chord or tone.

8. A method according to claim 1, wherein:

step (a) is effected using a plurality of sensors;

each event category has two associated audio signatures, one in the form of a verbal announcement and one of musical form; and the form of audio signature used for the event categories determined in step (c) is selected according to which sensor is activated by said person.

9. A method according to claim 1, wherein in step (d) the signatures are output simultaneously.

10. A method according to claim 1, wherein in step (d) the signatures are output sequentially.

11. A system for providing, in a physical environment, audio alerts in respect of categorized events to be reported; the apparatus comprising:

a sensor arrangement for detecting, without identifying, a person crossing a boundary of a space of the environment;

a processing subsystem arranged for (a) determining what categories of events that are to be reported, have occurred, each event being categorized at least according to the person or persons to be alerted in respect thereof; and (b) selecting from a set of predetermined audio signatures that each corresponds to a different possible category of event, the signature or signatures appropriate for the event categories determined by the first means; the determination being made no later than immediately following the detection of a person crossing a boundary by the sensor arrangement; and an audio output arrangement for outputting, within the hearing of the person detected by the sensor arrangement, the signatures selected by the second means of the processing subsystem either simultaneously or sequentially.

12. A system according to claim 11, wherein the sensor arrangement comprises a plurality of sensors and the processing subsystem being arranged to perform the selections to select event categories to be reported according to which sensor is activated by said person.

13. A system according to claim 11, wherein the sensor arrangement comprises the sensors of an intruder alarm system.

14. A system according to claim 11, wherein the sensor arrangement is arranged for detecting the de-activation of an intruder alarm system.

15. A system according to claim 11, wherein the processing subsystem is arranged to operate on the basis of events categorized both by the person or persons to be alerted and by type, the processing subsystem being arranged to perform the determination of the occurrence of events of at least two of the following types:

the receipt of e-mail;

the receipt of voice mail;

status events regarding equipment in the environment;

reminders recorded in an electronic diary.

16. A system according to claim 11, wherein said audio signatures are verbal announcements.

17. A system according to claim 11, wherein said audio signatures are musical in form with each signature being one of a music extract, a musical chord or tone.

18. A system according to claim 11, wherein:

the sensor arrangement comprises a plurality of sensors; and the processing subsystem is arranged to perform the selection for each event category to be reported, between two associated audio signatures according to which sensor is activated by said person, one signature being in the form of a verbal announcement and the other of musical form.

* * * * *